United States Patent [19]

Koros

[11] 3,998,625

[45] Dec. 21, 1976

[54] DESULFURIZATION METHOD

[75] Inventor: Peter J. Koros, Pittsburgh, Pa.

[73] Assignee: Jones & Laughlin Steel Corporation, Pittsburgh, Pa.

[22] Filed: Nov. 12, 1975

[21] Appl. No.: 631,347

[52] U.S. Cl. ..... 75/53; 75/58

[51] Int. Cl.[2] ..... C21C 7/02

[58] Field of Search ..... 75/53–59

[56] References Cited

UNITED STATES PATENTS

| | | | |
|---|---|---|---|
| 3,467,167 | 9/1969 | Mahin | 75/58 |
| 3,748,121 | 7/1973 | Atterbury | 75/53 |
| 3,885,956 | 5/1975 | Obst | 75/58 |
| 3,929,464 | 12/1975 | Todd | 75/58 |

*Primary Examiner*—Peter D. Rosenberg
*Attorney, Agent, or Firm*—Gerald K. White; T. A. Zalenski

[57] ABSTRACT

Desulfurization of molten ferrous metals such as pig iron is facilitated through the injection of a particulate fluidized mixture of non-oxidizing material and magnesium-containing reactive material by in-line mixing in a conveying line and consequent sub-surface injection. The amount of the contained magnesium, injection time, and contained magnesium injection rate are controlled to maximize process efficiency.

12 Claims, 1 Drawing Figure

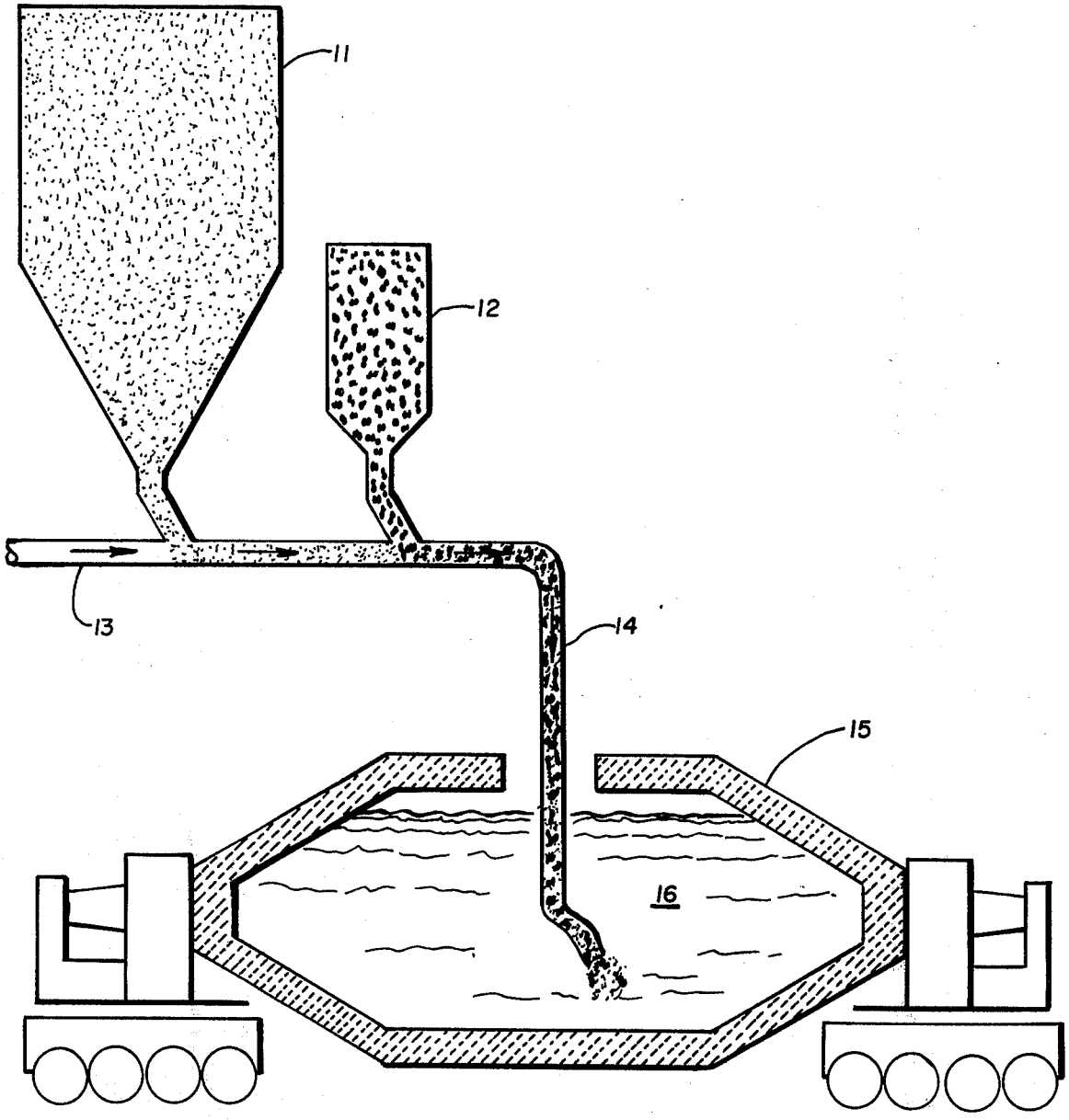
11
12
13
14
15
16

DESULFURIZATION METHOD

Although the invention is relevant to the field of the desulfurization of molten ferrous metals such as pig iron, cast iron, or steel, its most advantageous current application pertains to the desulfurization of molten pig iron produced at the blast furnace prior to its refinement into steel by steelmaking processes such as the open hearth and basic oxygen processes. Pig iron desulfurization has become increasingly necessary in recent years because of a general downward trend in maximum allowable steel sulfur contents and a tendency for increased pig iron sulfur contents.

The continuing demand for improved formability and surface quality for flat rolled steels coupled with a steady increase in ingot sizes have led to a reduction in maximum allowable steel sulfur contents. This trend is expected to accelerate in view of the growing use of lighter thickness sheet and strip products for difficult to form end uses in the appliance and automotive industries and the growing popularity of low sulfur steels such as the high-strength low-alloy families. Tus, it is becoming commonplace to produce steels to 0.015 to 0.025% maximum sulfur levels and to aim for 0.008% sulfur maximums for certain high quality steel.

Concurrently, blast furnace operators have been faced with a rise in sulfur content of metallurgical coke due to the relative lack of availability of low-sulfur coal. The above factor and the growing acceptance of certain operating practices that, while leading to higher pig iron productivity, result in higher pig iron sulfur contents, have led to pig iron sulfur contents on the order of 0.035 to 0.080% rather than the prior typical contents of 0.020% to 0.040%.

Because steelmaking processes such as the basic oxygen process, in normal mode of operation, remove only about one-third of the sulfur contained in the pig iron, it has become increasingly practical to effect sulfur removal at a stage prior to steelmaking. This invention may be utilized advantageously in this role.

Various desulfurization techniques for ferrous metals baths have been proposed in the art. Exemplary patents in the field include U.S. Pat. Nos. 2,823,989, 2,906,616, 2,906,617, 3,080,228 and 3,189,443. U.S. Pat. Nos. 2,823,989, 2,906,616 and 2,906,617 are illustrative of techniques utilizing lime-magnesium desulfurizing mixtures of fixed concentrations. The latter patent teaches an additional technique involving the injection of lime followed by a consecutive lime-magnesium injection step. U.S. Pat. Nos. 3,080,228 and 3,189,443 deal with the injection of magnesium spheres into cast irons. In addition, desulfurization techniques involving plunging containers filled with coke impregnated with magnesium into molten steel are known in the art. For reasons that will become more apparent later, none of the above cited patents are considered to possess the type of operational flexibility and advantages of the invention that is required to maximize desulfurization efficiency and minimize slag build-up through selection and control of magnesium input throughout the process.

One of the deficiencies in the processes described in several of the above mentioned patents is that use of fixed lime-magnesium contents result in the inability to independently control the rate of injection of the magnesium containing material and of the non-oxidizing material. To capitalize on the discovered benefit that to maximize efficiency of magnesium utilization, it is necessary to decrease the rate of magnesium input as the sulfur content is lowered, it is desirable to separately regulate the rate of feed of the two reagents. The non-oxidizing material should be introduced at a rate consistent with obtaining blow conditions that result in minimum ejection of slag and metal from the vessel. If fixed lime-magnesium contents were utilized and injection performed at relatively high magnesium input rates, an excessive, cumbersome load of slag would be created in the vessel and the amount of non-oxidizing material in excess of that required for smooth operation of the process would be wasted. These factors will become more obvious by examination of the Tables and examples provided in later portions of this description of the invention.

It is thus an object of the invention to provide a molten ferrous metal desulfurization process in which the utilization of magnesium-containing material is maximized.

It is an additional objective to provide a desulfurization process in which the respective inputs of non-oxidizing and magnesium-containing material can be altered and controlled to maximize process efficiency.

It is yet another object to provide a process of desulfurizing molten ferrous metals with a magnesium-containing material in which vaporized magnesium is substantially prevented from being ejected from the molten ferrous metal and thereby avoiding dimunition of air quality.

A further objective is to provide a desulfurization process in which excessive slag build-up is not encountered.

A still further objective is to provide a ferrous metal desulfurization process that may be controlled in accordance with a relationship between sulfur content and the amount of magnesium input rate, and total magnesium input.

These and other objectives and advantages will be apparent to those skilled in the art from the following description of the invention.

The invention generally involves the formation of a fluidized mixture of a particulate material that is non-oxidizing with respect to molten ferrous metal and a non-oxidizing carrier gas, then introducing particulate magnesium-containing material into the fluidized mixture, and injecting the freshly formulated mixture beneath the surface of a sulfur-containing ferrous metal bath to desulfurize the ferrous metal. The process may also involve reducing the rate of magnesium-containing material during the injection step as the sulfur content is lowered. Such reduction leads to improved efficiency of the magnesium addition usage and minimizes the potential for air pollution due to the escape of magnesium vapors as copious white fumes from the bath.

The FIGURE illustrates apparatus suitable for performing the method of the invention.

The invention comprises forming a fluidized mixture of a particulate material that is non-oxidizing with respect to molten ferrous metal and a non-oxidizing carrier gas. Particulate magnesium-containing material is then added to the fluidized mixture in the quantities required to promote desulfurization efficiency. In this manner, the relative amount and rate of magnesium injection can be regulated independently during the course of the process. Such flexibility is not achievable when using the pre-mixed lime and magnesium injection agents of the prior art because of the fixed ratio of the respective ingredients. The ability to control the injection rate of magnesium-containing material is fundamental to the process to obtain a consistent and high efficiency of magnesium utilization. Moreover, the pre-mixed lime-magnesium injection agents with which I am familiar tend to be unevenly mixed or segregated. This characteristic leads to two problems of a practical nature. First of all, lance breakage is a common occurrence because surges in magnesium feed rate cause vibration of the lance which tends to crack its refractory insulation. Secondly, relatively large surges of magnesium can lead to a loss of desulfurization efficiency due to instantaneously high injection rates. Surging thus also may lead to periodic emission of magnesium vapor from the bath.

Suitable apparatus for desulfurizing molten ferrous metal in accordance with the invention is set forth in the FIGURE. Particulate material that is non-oxidizing to molten ferrous metal is fed from fluidizing hopper 11 into transport line 13 where it is mixed with a carrier gas so as to form a fluidized mixture. Hopper 11 is pressurized with a gas, such as nitrogen, to enable the particulate material to be fed into transport line 13 in the fluidized state and at a regulated rate. The carrier gas is fed into transport line 13 from a conventional feed source not illustrated in the FIGURE and located upstream from hopper 11. The gas is fed into the transport system at a velocity suitable for maintaining a fluidized mixture. Typically carrier gas rates of from about 10 to 80 cubic feet per minute are suitable for this purpose. Following establishment of the fluidized mixture, magnesium-containing particulate material is introduced into the previously created fluidized mixture from hopper 12. Hopper 12 should be pressurized in a manner similar to hopper 11 but its pressure need not be sufficient to create a fluidized entry stream. The pressure need only to be greater than that prevailing in transport line 13. Following formation of the desulfurizing mixture in transport line 13, the mixture is conveyed to lance 14 and injected beneath the surface of ferrous metal bath 16 which is contained in refractory-lined holding vessel 15. While vessel 15 is shown in the form of a submarine transport vessel, any convenient holding vessel may be utilized. Lance 14 may comprise a light-weight refractory coated steel pipe. It is advantageous to provide a 30° to 45° bend near to the exit end of lance 14 to promote mixture of the desulfurizing agent and the bath, to promote bath circulation, and to minimize lance attack from any locally formed magnesium vapor.

While the desulfurization control of the invention is effected through regulation of magnesium input, it is necessary to incorporate a particulate material that is non-oxidizing with respect to molten ferrous material along with the magnesium-containing material for purposes of providing for dispersion of the magnesium-containing material in the ferrous bath, thereby preventing the formation of large gas bubbles which lead to relatively low desulfurization efficiency. An additional important function of the non-oxidizing material is that its presence permits the delivery of the magnesium-containing material at relatively low rates, i.e., about 4 to 30 lbs./min. without lance plugging or requiring complex lance design. Moreover, the separate control of feed rate of the non-oxidizing material and magnesium-containing material enables magnesium input to be varied in accordance with decreases in sulfur content of the ferrous metal while maintaining a substantially constant input of the non-oxidizing material. While not essential, it is also advantageous that the non-oxidizing material also functions to desulfurize the ferrous material as generally less magnesium is then required to reach a specific process end-point.

Suitable non-oxidizing particulate materials include but are not limited to: lime, various metallurgical slags, alumina, fly ash, silica, calcium carbide and the like. Lime constitutes a preferred material because of its commercial availability and desulfurizing propensity. The non-oxidizing material should be sized so that about 80 percent of the particles are less than about 100 microns (80% will pass through a 150 U.S. Sieve No. mesh screen). It is a preferred embodiment to utilize a non-oxidizing material sized so that about 98% of the particles are less than about 44 microns (98% will pass through a 325 U.S. Sieve No. screen) due to considerations related to fluidized transportation efficiency. This preference is because generally lower amounts of carrier gas are required to transport finer sized material and, as a consequence, less splashing of the bath results when finer sized material is used. Particulate non-oxidizing material should be injected at a rate of about 90 to 300 lbs./min., because this range of flow rates provide sufficient amounts of material for adequate magnesium dispersion in the molten ferrous metal for the range of magnesium inputs within the scope of the invention. Typically, for use in treatment of a 170 net ton quantity of metal, non-oxidizing material is injected at rates of about 130 lbs.min., because this rate results in the smoothest flow of materials and operation of the process. For the desulfurization of pig iron from 0.050%S to 0.015%S with lime and magnesium, a flow rate of about 130 lbs./min. involves the use of about 11 lbs. of lime per net ton of pig iron.

Various carrier gases may be used in the practice of the invention provided that such gases are non-oxidizing with respect to molten ferrous metal. Suitable gases include: inert gases such as nitrogen and argon and various reducing hydrocarbon gases such as natural gas, coke oven gas, propane and the like. The use of reducing hydrocarbon gases as a carrier gas is illustrated in U.S. Pat. No. 3,876,421. Quantities of approximately from 0.03 to 0.15 $ft.^3$ of carrier gas per pound of non-oxidizing material may be used to transport and inject the fluidized mixture during the process. Hydrocarbon reducing gases are preferred because of their propensity to promote mixing upon their decomposition during reaction with the ferrous metal bath and because the reducing gas reacts with and removes the layer of oxidizing gas (air) which envelopes the individual particles of the non-oxidizing particulate material. The oxidizing layer is formed during the manufacture of the particles in connection with the grinding process. The use of hydrocarbon reducing gases rather than inert gases lead to a desulfurization improvement on the order of 0.002%S per treatment. It is preferred to use from about 0.07 to 0.10 $ft.^3$ of carrier gas per pound of non-oxidizing material for an injection pipe inside diameter of 1.5 inches because this range results in the smoothest flow of materials and minimal splashing upon injection into the bath.

The desulfurization agent of the invention should contain magnesium because magnesium is a more potent desulfurization agent than commonly used calcium-containing agents such as calcium carbide. Unlike calcium, magnesium functions to continue to remove sulfur even after the desulfurization process has been completed due to its retention in liquid solution in the ferrous metal. In the case of pig iron desulfurization, sulfur reduction is believed to continue to some extent until the magnesium is consumed during subsequent steelmaking. The above phenomenon has been observed following desulfurization with magnesium impregnated coke. However, the process of the invention apparently results in greater saturation of iron with magnesium than in the case of treatment with magnesium impregnated coke because a definite improvement in "post-treatment" sulfur removal has been observed. Such improvement is considered to be an important advantage of the invention and is generally helpful in the attainment of lower steel sulfur contents.

Suitable particulate magnesium-containing material includes commercially pure magnesium, magnesium alloys such as magnesium-aluminum alloys and others as well as various other magnesium-containing substances. Commerically pure magnesium is preferred from the standpoint of cost and also because it presently appears that on a contained magnesium basis, greater desulfurization efficiency is realized than with magnesium alloys. On the other hand, desulfurization process control is generally enhanced with use of magnesium alloys such as the magnesium-aluminum type due to their lower magnesium content which results in the ability to use larger input quantities of the alloy than required when using commercially pure magnesium to achieve a given amount of sulfur removal.

The particulate magnesium-containing material should be sized so that substantially all of its particles are less than about 300 microns (substantially all particles will pass through a 50 U.S. Sieve No. screen) to assure smoothness of the injection step. Sizes larger than about 300 microns lead to injection lance plugging and blockage. It is preferred to restrict the particle size to a maximum of about 420 microns (substantially all particles will pass through a 40 U.S. Sieve No. screen) to further ensure the achievement of smooth injection condition. Due to the pyrophoric nature of pure magnesium and particularly of its most common alloys with aluminum, the injection material should not contain significant quantities of particles below about 44 microns (particles passing through a 325 U.S. Sieve No. screen). Based upon contained magnesium content, the particulate magnesium-containing material should be injected into the bath at a rate between about 4 to 30 lbs./minute. The lower limit is selected because lesser amounts involve unduly long treatment times while the upper limit is selected because rates appreciably over 30 lbs./minute exceed the capability of the molten ferrous metal bath to dissolve substantially all of the magnesium and thereby lead to a reduction in efficiency of magnesium utilization.

It has also been discovered that the desulfurization of molten ferrous metal with magnesium may be further advantageously controlled within the previously stated processing parameters because the efficiency of magnesium usage, or, stated a different way, the percentage of that added actually contributing to sulfur removal, decreases as the sulfur content of the bath decreases. Therefore, by reducing the rate of magnesium introduction as sulfur is removed from the bath during the process, one may effectively maximize the efficiency of magnesium utilization. Aside from beneficial cost considerations, the reduction of the rate of magnesium injection during the process enables the magnesium to be consumed to an extent that the occurrence of magnesium vapor plumes in the work area is avoided. Such plumes would normally occur unless the injection rate is lowered as sulfur decreases. Therefore, it may be seen that the process may be designed to introduce magnesium at a rate that is compatible with efficient magnesium consumption at a given sulfur level.

The relationship between molten ferrous metal sulfur content and magnesium input is defined by the following expression:

$$F_s = A - B\frac{(1)}{(R)} + C\frac{(I_s)}{(T)},$$

where, $F_s$ = Sulfur content at end of process,
$A$ = Constant,
$B$ = Constant,
$R$ = lbs. Mg/Min.,
$C$ = Constant,
$I_s$ = Sulfur content at time calculation made during process, and
$T$ = lbs. Mg/ton of molten ferrous metal.

It is evident that three factors are involved in the achievement of the desired final sulfur. They are: the magnesium input rate expressed as lbs./min., the overall amount of magnesium injected expressed as lbs./ton of molten ferrous metal, and the initial sulfur content of the ferrous metal.

The single most important variable defining desulfurization efficiency according to the process is the magnesium input rate. This factor is illustrated in Table I. At sulfur levels on the order of 0.030%S the maximum tolerable rate of magnesium input is greater than that at about 0.010%S. This underscores the need for varying the rate of magnesium input as treatment proceeds. The tests were performed with use of lime and pure magnesium injection with natural gas as the carrier or transport gas. A lime rate of about 130 to 140 lbs./min. was utilized.

Table I

| Initial Sulfur(%) | Final Sulfur(%) | Lbs.Mg/ Minute | Lbs.Mg/Net Ton Pig Iron | Injection Time (Min.) | Slag Generation (lbs.) |
|---|---|---|---|---|---|
| .070 | .025 | 6 | .63 | 18.0 | 2340 |
| .070 | .025 | 10 | .77 | 13.6 | 1750 |
| .070 | .025 | 16 | .93 | 10.2 | 1335 |
| .040 | .010 | 6 | .60 | 17.0 | 2210 |
| .040 | .010 | 10 | .91 | 15.5 | 2010 |
| .040 | .010 | 16 | 1.28 | 13.8 | 1790 |
| .025 | .005 | 6 | .48 | 13.6 | 1770 |
| .025 | .005 | 10 | .85 | 14.6 | 1890 |

The desulfurization process may be controlled through utilization of the relationship in several manners. First of all, with a known initial sulfur content and knowledge of available processing time, one may utilize a total amount and input rate of magnesium consistent with the maximization of magnesium efficiency by injecting at a rate in accordance with the above relationship. This form of process control is effective to minimize the amount of magnesium required to remove a given amount of sulfur as well as to minimize the creation of substantial amounts of magnesium vapor above the ferrous metal bath. When process time must be held to the absolute minimum, the relationship presented above can be used to calculate the amount of magnesium which will be required to compensate for the loss in efficiency which results from use of injection rates in excess of the optimum for each sulfur level.

It is preferred, however, to adjust the magnesium input rate during the course of the desulfurization treatment because the desulfurization of molten ferrous metals with particulate magnesium containing materials is sensitive to magnesium input rate at various sulfur levels and thus further process improvement may be achieved through rate adjustment during the process. Because magnesium efficiency decreases with decreasing sulfur content, it is evident that it is advantageous to reduce the rate of magnesium input as the process progresses. This relationship may be advantageously implemented by decreasing the input rate in a series of discrete steps based upon estimated or measured sulfur content at a given point or points during the process. The equation defining the relationship may be used in connection with control for each step. This may be performed through statistical determination of constants appropriate for given desulfurization agents, vessel geometry, and lance system and then plotting the resultant equation. The plot is then used as a guide for process control.

A favorable combination of magnesium consumption and treatment rate for treating pig iron to reduce sulfur from 0.100 to 0.008% is shown in Table II. The rates and times were selected in accordance with the relationship with an aim of maximizing magnesium utilization.

TABLE II

| S Content At Start of A Step | Lbs./Min. of Mg | Lbs./NT of Mg | Blow Time Min. | S Content at End of Step |
|---|---|---|---|---|
| .100% | 20 | .49 | 4.1 | .070 |
| .070 | 15 | .58 | 6.6 | .040 |
| .040 | 10 | .45 | 7.4 | .025 |
| .025 | 6 | .41 | 11.6 | .008 |

Those knowledgeable in the art will realize that the process relationship of the invention is also suitable for continuous automatic control with use of conventional computer systems. The rate of magnesium feed would be decreased continuously as directed by the above mentioned relationship.

The following relationship was developed for control of the process using lime and commercially pure magnesium powder, submarine vessels, and a single-hole lance:

$$F_s = .0061 - .098 \frac{(I)}{(R)} + .3357 \frac{(I_s)}{(T)}$$

where, $F_s$ = Sulfur content at end of process, $R$ = Lbs. Mg/Min., $I_s$ = Sulfur content at time calculation made during process, and $T$ = Lbs. Mg/ton of molten ferrous metal.

The above relationship was calculated by linear regression analysis data from 118 trials utilized.

For magnesium-aluminum alloys containing at least 50% magnesium, submarine vessels, and a single-hole lance, the constants change slightly to $$F_s = .0065 - .118 \frac{(I)}{(R)} + .348 \frac{(I_s)}{(T)}$$

The precision for prediction of the sulfur content to be attained at the end of treatment is 0.0038%S and 0.004%S for one standard deviation, respectively, for treatments using commercial purity and alloyed magnesium. Within the normal constraints of treatment time and magnesium efficiency, examination of these equations leads to the conclusion that when the ferrous metal contains more than 0.050%S, the magnesium rate term has a very minor effect. On the other hand, when the bath contains less than about 0.025%S, and particularly below 0.010%S, the rate of magnesium injection assumes dominant importance from the point of view of process efficiency.

The following examples are believed to demonstrate the accuracy and practicability of the control technique as well as several of the embodiments of the invention and its teachings. Natural gas was used as the carrier gas for all examples.

EXAMPLE 1

The influence of a relatively low magnesium injection rate may be observed from the desulfurization of a 199 ton batch of pig iron with a mixture of lime and commercially pure magnesium. Magnesium was injected at a rate of 5.5 lbs./min. in an amount of 0.38 lbs./ton of pig iron for a time of 13.9 minutes. Lime was injected at a rate of 149.2 lbs./min. Sulfur was reduced from 0.037 to 0.019%. The predicted final sulfur content was 0.018%. Magnesium usage efficiency was considered to be excellent as only a very light plume of magnesium vapor was observed.

EXAMPLE 2

A 153 ton batch of pig iron was injected for 8.6 minutes with magnesium, at a relatively high input rate to reduce sulfur from 0.032 to 0.010%. Final sulfur content was predicted to be 0.012%. Lime and commercially pure magnesium were injected at rates of 158 and 15.6 lbs./min., respectively. Magnesium was injected in an amount of 0.88 lbs./ton of pig iron. Visible amounts of magnesium vapor were observed during the course of the process. This observation was not unexpected due to the relatively higher rate of magnesium employed when contrasted with that of Example 1. A comparison of these respective Examples indicates the trade-off of magnesium utilization efficiency with processing time.

EXAMPLE 3

The sulfur content of 140.4 ton batch of pig iron was reduced from 0.044 to 0.015% by injection of lime and a 54% magnesium-aluminum alloy for 12.9 minutes. The predicted final sulfur content was 0.016%. Lime and the magnesium-aluminum alloy (based upon contained magnesium) were injected at rates of 106.2 and 6.3 lbs./min., respectively and the magnesium input was 0.57 lbs./ton of pig iron. The injection resulted in very quiet bath conditions and a minimal amount of evolved magnesium vapor. This condition indicates high magnesium efficiency due to the relatively low injection rate of magnesium.

EXAMPLE 4

Lime and the 54% magnesium-aluminum alloy were injected into 185.9 tons of pig iron for 14 minutes with a resultant reduction of sulfur from 0.029 to 0.010%. Predicted final sulfur was 0.014%. Lime and the magnesium-aluminum alloy were injected at respective rates of 97.8 and 9.1 lbs./min. Total magnesium injected was 0.51 lbs./ton of pig iron. The injection process was characterized by the appearance of heavy magnesium vapor fumes. This indicates a relatively low efficiency of magnesium usage. The probable cause of the relatively poor efficiency is believed to be related to the use of the relatively high magnesium rate with low sulfur pig iron and perhaps also due to the use of a lime injection rate falling near the lower limit of the invention.

EXAMPLE 5

A 163.4 ton batch of pig iron having an initial sulfur content of 0.044% was treated with lime and commercially pure magnesium for 13.4 minutes to reduce sulfur to 0.013%. Predicted sulfur content was also 0.013%. Magnesium was injected at a rate of 10.0 lbs./min. with a resultant usage of 0.82 lbs./ton of pig iron. Lime was injected at a rate of 212.3 lbs./min. The process evolved magnesium vapor and a substantial slag build-up occurred. The latter condition is believed to be due to the relatively high lime addition rate while the vapor is believed to have been caused by the relatively high magnesium rate and relatively low initial sulfur content.

EXAMPLE 6

A mixture of lime and commercially pure magnesium was employed to desulfurize 175 tons of pig iron in a three-step embodiment of the invention. During the first step of the treatment lime and magnesium were injected at rates of 183.7 and 10.7 lbs./minute respectively for 7.4 minutes. Sulfur was reduced from 0.060 to 0.047%. Predicted sulfur content was 0.042%. The 10.3 minute injection of lime and magnesium at rates of 141.5 and 9.6 lbs./min. during the second step lowered sulfur to 0.019% although the predicted sulfur level was 0.024%. The third step of 14.0 minutes duration resulted in a final sulfur content of 0.005 with a predicted level of 0.007. During this stage of the process, lime and magnesium injection rates were 123.8 and 7.8 lbs./min., respectively. This example illustrates a mode of lowering the magnesium injection rate as the sulfur content of the pig iron decreases. Magnesium usage efficiency may be increased in this fashion. Injection conditions were considered to be excellent reflecting adherence to the discovered principle that magnesium input rate should be decreased as sulfur is removed from the pig iron.

I claim:

1. A method for desulfurizing molten ferrous metal, comprising:

a. Forming a fluidized first mixture of a particulate material that is non-oxidizing with respect to molten ferrous metal and is selected from the group consisting of lime, metallurgical slag, alumina, fly ash, silica, and calcium carbide and sized so that about 80 percent of its particles are smaller than about 100 microns with a non-oxidizing carrier gas;

b. Introducing particulate magnesium-containing material sized so that substantially all of its particles are below about 300 microns into said first mixture to form a second mixture; and then c. Transporting and injecting the second mixture beneath the surface of sulfur-containing molten ferrous metal so as to remove sulfur from said ferrous metal, said non-oxidizing particulate material and said magnesium-containing material injected at a rate of from about 90 to 300 lbs./min. and from about 4 to 30 lbs. of contained magnesium/min., respectively, and further controlling injection of said magnesium-containing mixture by reducing the rate of injection of the magnesium-containing material in response to sulfur content of said molten ferrous metal in accordance with the following relationship:

$$F_s = A - B\frac{(1)}{(R)} + C\frac{(I_s)}{(T)},$$

where, $F_s$ = Sulfur content at end of process,
$A$ = constant,
$B$ = constant,
$R$ = Lbs. Mg/min.,
$C$ = constant,
$I_s$ = Sulfur content at time calculation made during process,
$T$ = Lbs. Mg/ton of molten ferrous metal.

2. The method of claim 1, wherein:
$A = 0.0061$;
$B = 0.098$; and
$C = 0.3357$; and
said non-oxidizing particulate material comprises lime and said magnesium-containing material comprises magnesium.

3. The method of claim 1, wherein:
$A = 0.0065$;
$B = 0.118$; and
$C = 0.348$; and
said non-oxidizing particulate material comprises lime and said magnesium-containing material comprises a magnesium-aluminum alloy.

4. The method of claim 1, wherein:
said non-oxidizing particulate material comprises lime.

5. The method of claim 1, wherein:
said magnesium-containing particulate material is selected from a member of the group consisting of magnesium, magnesium-aluminum alloys, and mixtures thereof.

6. The method of claim 5, wherein:
said non-oxidizing particulate material comprises lime.

7. The method of claim 1, wherein:
said fluidized mixture contains from about 0.07 to 0.10 ft.$^3$ of carrier gas per lb. of non-oxidizing particulate material.

8. The method of claim 1, wherein:
said reduction in rate of injection of said magnesium-containing material is performed in steps.

9. The method of claim 1, wherein:
said reduction in rate of injection of said magnesium-containing material is performed continuously.

10. A method for desulfurizing molten ferrous metal, comprising:

a. Forming a fluidized first mixture of a particulate material that is non-oxidizing with respect to molten ferrous metal and is selected from the group consisting of lime, metallurgical slag, alumina, fly ash, silica, and calcium carbide and sized so that about 80 percent of its particles are smaller than about 100 microns with a non-oxidizing carrier gas;

b. Introducing particulate magnesium-containing material sized so that substantially all of its particles are below about 300 microns into said first mixture to form a second mixture; and then c. Transporting and injecting the second mixture beneath the surface of sulfur-containing molten ferrous metal so as to remove sulfur from said ferrous metal, said non-oxidizing particulate material and said magnesium-containing material injected at a rate of from about 90 to 300 lbs.min. and from about 4 to 30 lbs. of contained magnesium/min., respectively; and d. reducing the rate of magnesium-containing material injection during the injection step in response to sulfur content of said molten ferrous metal so as to minimize the creation of substantial amounts of vaporized magnesium above the surface of said molten ferrous metal.

11. The method of claim 10, wherein:

the rate of non-oxidizing particulate material injection is maintained substantially constant during the injection step.

12. The method of claim 1, wherein:

The rate of non-oxidizing particulate material injection is maintained substantially constant during the injection step.

* * * * *